US006190074B1

(12) United States Patent
Demellier et al.

(10) Patent No.: US 6,190,074 B1
(45) Date of Patent: Feb. 20, 2001

(54) MECHANISM FOR ROTATING CASE

(75) Inventors: Stephane Demellier, Annecy; Pierre Joulia, Saint Jorioz, both of (FR)

(73) Assignee: The Estee Lauder Companies, Inc., New York, NY (US)

( * ) Notice: Under 35 U.S.C. 154(b), the term of this patent shall be extended for 0 days.

(21) Appl. No.: 09/423,985

(22) PCT Filed: Jul. 12, 1999

(86) PCT No.: PCT/FR99/01701

§ 371 Date: Apr. 10, 2000

§ 102(e) Date: Apr. 10, 2000

(87) PCT Pub. No.: WO00/03617

PCT Pub. Date: Jan. 27, 2000

(30) Foreign Application Priority Data

Jul. 17, 1998 (FR) ..... 98 09250

(51) Int. Cl.[7] ..... B43K 21/08

(52) U.S. Cl. ..... 401/78; 401/68; 401/75; 401/77

(58) Field of Search ..... 401/68, 70–79, 401/DIG. 1

(56) References Cited

U.S. PATENT DOCUMENTS

| | | | |
|---|---|---|---|
| 2,818,973 | 1/1958 | Croce et al. | 401/75 |
| 3,771,881 | 11/1973 | Swenson | 401/75 |

FOREIGN PATENT DOCUMENTS

| | | | |
|---|---|---|---|
| 249508 | 4/1948 | (DE) . | |
| 1133527 | 11/1968 | (GB) | A45D/39/10 |
| 8-275823 | 10/1996 | (JP) | A45D/40/04 |
| 9-000345 | 1/1997 | (JP) | A45D/40/04 |

*Primary Examiner*—Henry J. Recla
*Assistant Examiner*—Tuan Nguyen
(74) *Attorney, Agent, or Firm*—Karen A. Lowney; Peter M. Giancana

(57) ABSTRACT

Turning case mechanism particularly for cosmetic products, composed of a pivoting body mounted in rotation on a main piece, formed by a traveler, base and hinge elements connecting the base to the traveler, between a lower articulation point with the base and an upper articulation point with the traveler; said traveler intended to be mobile between an open or upper position and a closed or lower position, characterized in that when the traveler is in the lower position, the hinge elements are arranged at least in part below the horizontal plane that contains the lower articulation point.

16 Claims, 9 Drawing Sheets

3

MECHANISM FOR ROTATING CASE

This invention concerns a turning case mechanism, the same type as those used for cosmetic products, such as lipsticks or lip creams, for example.

A number of turning cases are known in the prior art, such as the one described in the applicant's French patent request no. 97 10166, for example. The principle behind these cases consists of making a traveler—a product-holding device—move axially by means of rotating a body with a spiral groove in which a finger or guide pin of the traveler intended for running inside said groove, cooperates. This type of mechanism requires means for blocking the traveler in rotation with respect to the pivoting body in such a way as to bring about the axial movement of the latter when the spiral groove pivots thus making the finger or guide pin of the traveler run inside of it.

These blocking means can be comprised of an independent third piece, such as a base, for example, from which two parts with a longitudinal profile extend, intended to cooperate with two peripheral channels in the outside of the traveler for guiding it when it slides and stopping it in rotation with respect to the pivoting body. However, these mechanisms can also only be comprised of two separate pieces i.e., a conventional pivoting body and a main piece comprising a base, a traveler and articulated hinges connecting the base to the pivoting body allowing one piece to move axially with respect to the other by opening up but preventing any rotation between them.

However, these devices, though they have the advantage of reducing the number of pieces needed for the turning case mechanism, nevertheless have disadvantages related to the delicacy of the hinges' movement between the pieces, as well as their placement in a closed position. The superposition of the hinge elements above the base is a problem in complying with the size constraints of this type of cosmetic product, and in particular for long bases, chosen for aesthetic reasons.

The object of the present invention is to resolve the above-mentioned problems with means that are simple, reliable, inexpensive and easy to implement. It proposes a turning case mechanism capable of being used in cosmetology that is solid with a reduced size with respect to similar products of the prior art.

According to its main feature, the turning case mechanism—particularly suitable for cosmetic products according to the invention—is comprised of a pivoting body mounted in rotation on a main piece, formed by a traveler, a base and hinge elements connecting the base to the traveler between a lower articulation point on the base and an upper articulation point on the traveler. This traveler is intended to be mobile between an open or upper position and a closed or lower position and is characterized in that when the traveler is in the lower position, the hinged elements are arranged at least in part below the horizontal plane that contains the lower articulation point.

Another feature of the turning case mechanism is the base with a space extending below the lower articulation point, in which at least a portion of the hinge elements is placed, when the traveler is in the lower position.

According to one embodiment of the turning case mechanism, the space is made by a reaming out of the base.

According to another feature of the turning case mechanism according to the invention, when the traveler is in the lower position, all of the hinge elements are arranged below the horizontal plane that contains the lower articulation point.

According to the preferred embodiment of the turning case mechanism, the hinge elements are comprised of two elements, a lower element and an upper element articulated between themselves at an intermediate articulation point.

There is another feature of the turning case mechanism wherein the lower articulation points between the base and the lower element and the upper element, between the traveler and the upper element, the lower and upper elements are arranged in alignment on either side of the mechanism in a mean longitudinal plane when the traveler is in the upper position.

According to one of the embodiment variations of the turning case mechanism, at least a part of the traveler is below the horizontal plane that contains the lower articulation point, when in the lower or closed position.

According to this embodiment variation, the traveler has in its lower portion a clearance notch in which one of the hinge elements is positioned in part when the mechanism is in the lower or closed position.

According to another characteristic of the turning case mechanism according to the invention, when the traveler is in the lower or closed position, the upper articulation point is situated below the horizontal plane containing the lower articulation point.

According to another characteristic of the turning case mechanism, the latter is characterized in that it has stopping means constituted of stop surfaces of the pivoting body and support surfaces of the traveler of the main piece.

According to one embodiment of the turning case mechanism according to the invention, the support surfaces are arranged on the traveler's guide pins and are formed by the pins' beveled surfaces.

According to this embodiment, the stop surfaces are arranged in the inner grooves of the pivoting body at their respective ends.

According to pother characteristic of this embodiment, the stopping means have side support and stop surfaces which prevent the rotation between the traveler and pivoting body in the extreme positions of the closed and opened traveler and side support and stop surfaces that prevent any longitudinal movement of the traveler in the pivoting body when it is in its open position.

According to an additional characteristic of the turning case mechanism invention, it is characterized in that the hinge elements have a rounded or curved transversal profile.

According to another characteristic of the turning case mechanism, the main piece is fabricated in a plastic material chosen among the polyolefin and acetylic materials.

Other features and advantages of the invention will become evident from the following description referring to the attached drawings which are provided by way of illustrative and non-limiting examples.

FIGS. 1*a* through 14*c* illustrate the preferred mode of embodying the turning case mechanism and a variation thereof.

FIGS. 1*a* through 7*b* illustrate a first preferred embodiment of the turning case mechanism.

FIG. 1*a* illustrates a longitudinal section ol the turning case mechanism, in its open or upper position.

FIG. 1*b* illustrates a view from below of the mechanism in the open position.

Figure 7A:
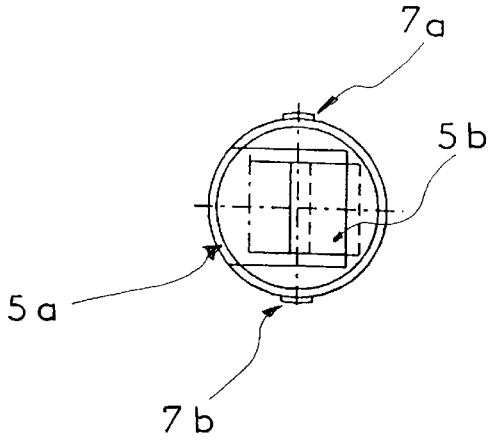
Figure 7B:
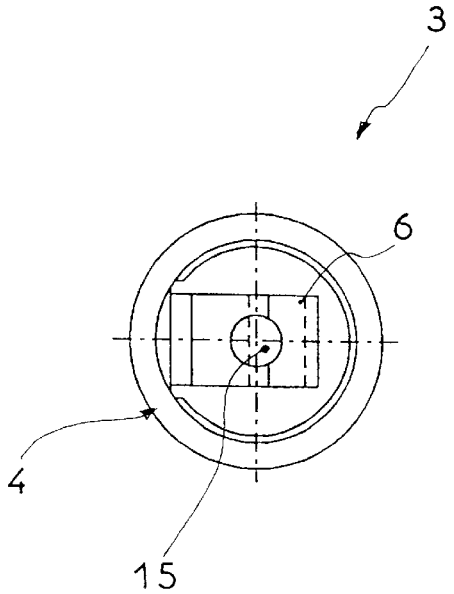

FIGS. 7*a* and 7*b* represent a cross-section of the main piece, according to AA and BB, respectively.

FIGS. 8 through 14*c* illustrate an embodiment variation of the turning case mechanism.

Figure 2:
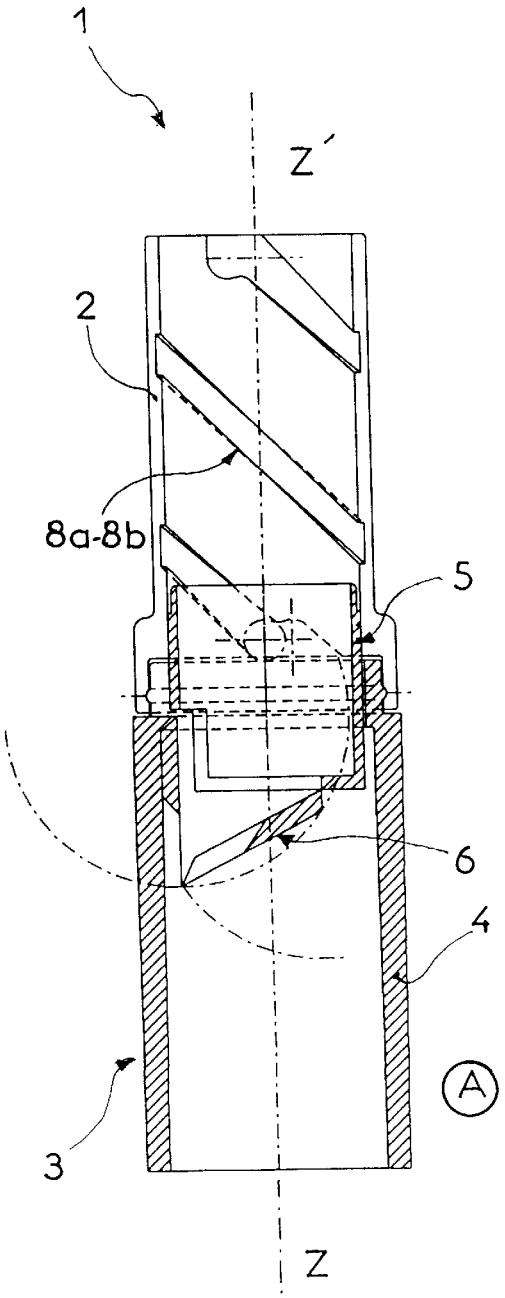
FIG. 2 illustrates a view similar to that of FIG. 1*a* of the turning case mechanism in a closed or lower position.
Figure 8:
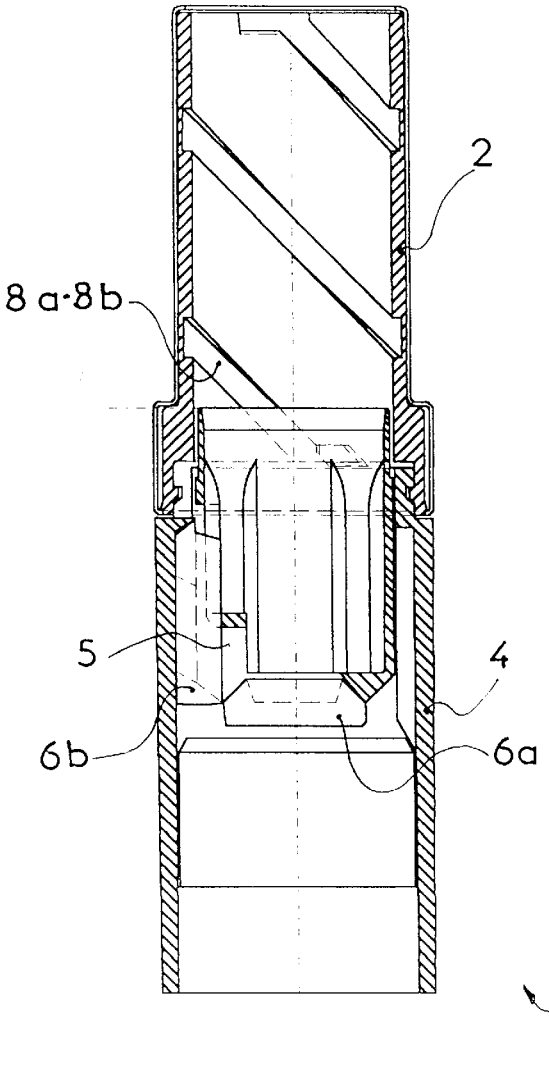

FIG. 8 illustrates the turning case mechanism according to a view similar to FIG. 2.

Figure 9:
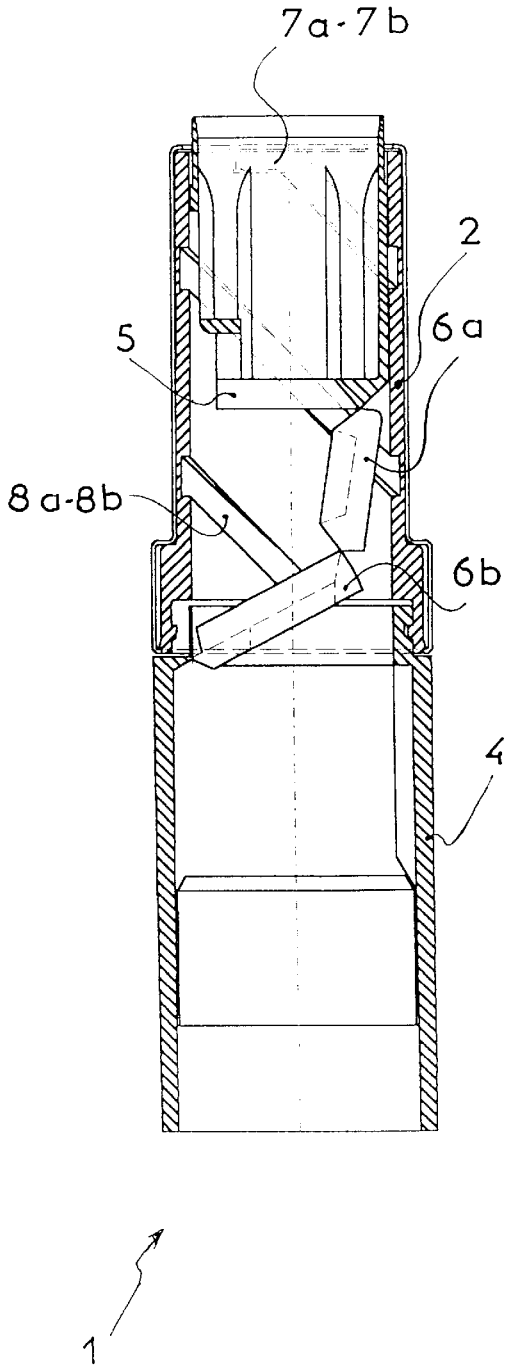

FIG. 9 represents a longitudinal section of the turning case mechanism in an intermediate position.

Figure 10A:
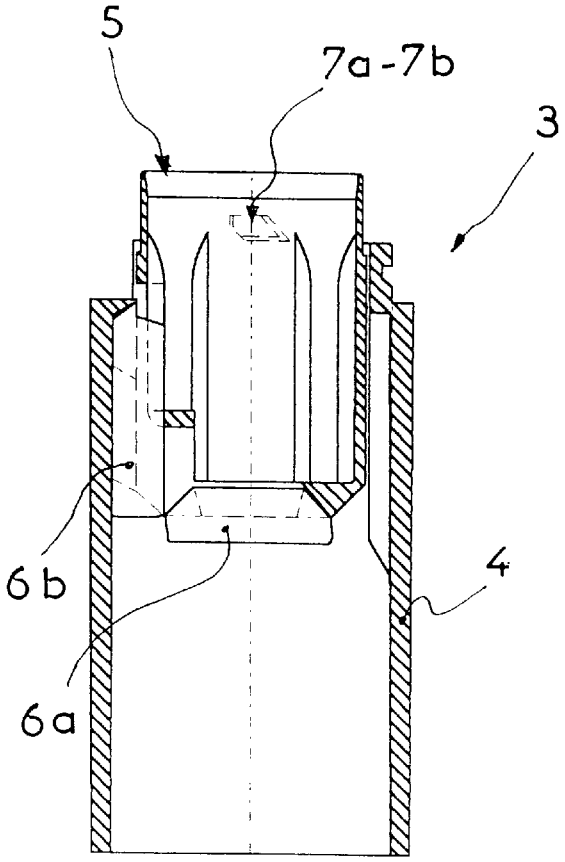
Figure 10B:
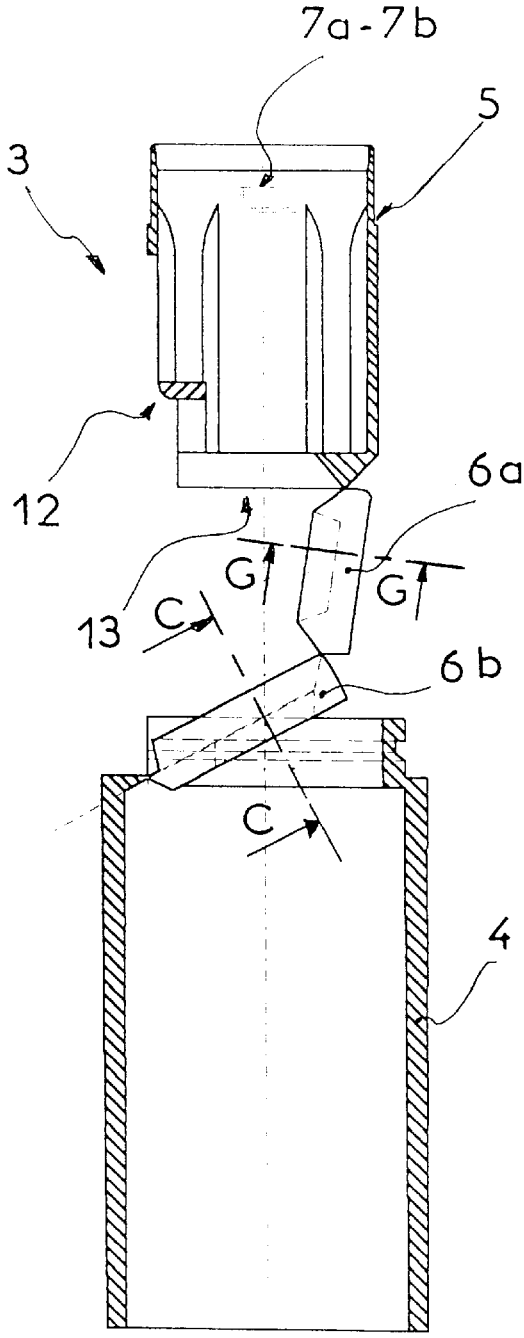

FIGS. 10*a* and 10*b* illustrate a longitudinal section of the mechanism's main piece in the closed position and in an intermediate position, respectively.

Figure 11A:
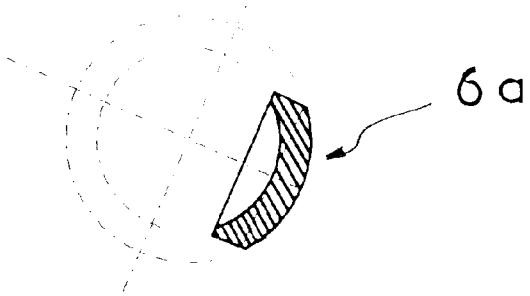
Figure 11B:
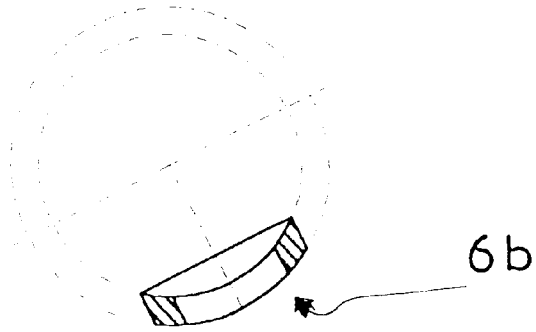

FIGS. 11*a* and 11*b* illustrate a cross-section of the main piece's hinge elements according to GG and CC, respectively.

Figure 12A:
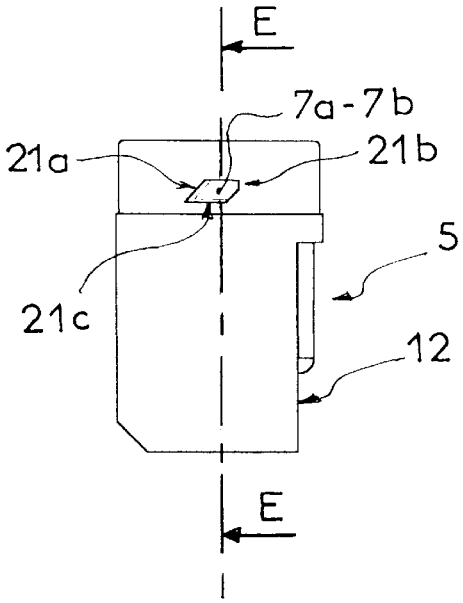
Figure 12B:
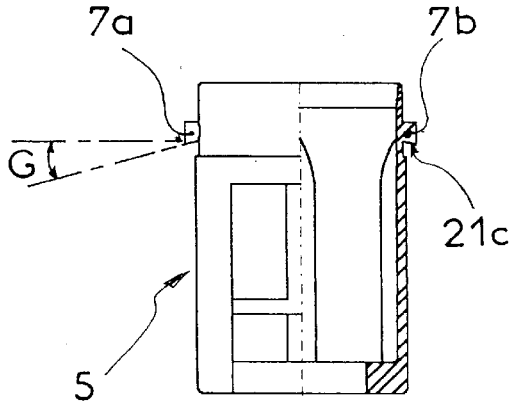
Figure 12C:
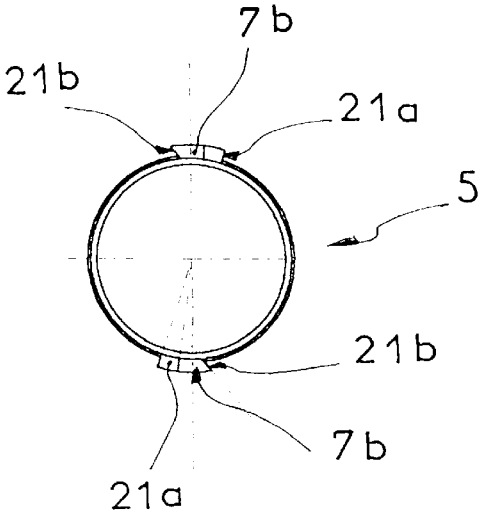

FIGS. 12*a*, 12*b* and 12*c* represent the traveler of the main piece and its guide pins from the front, from the side with a partial cross section according to EE and from above, respectively.

Figure 13:
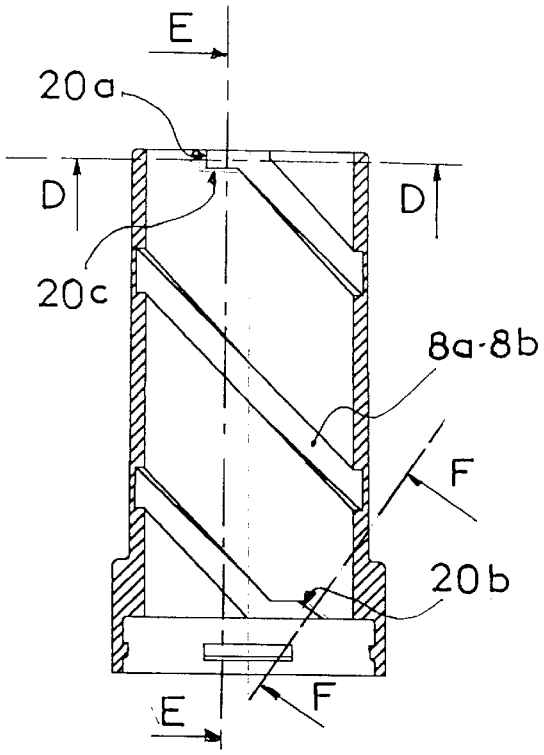

FIG. 13 illustrates the front view of the pivoting body of the turning case mechanism.

Figure 14A:
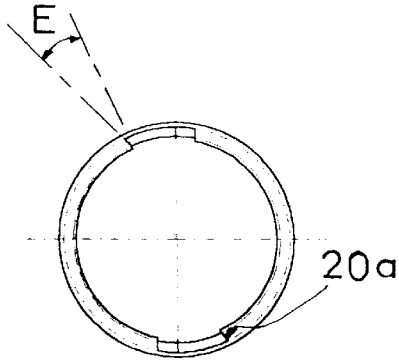
Figure 14B:
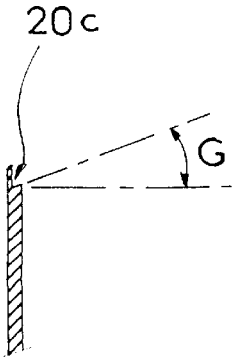
Figure 14C:
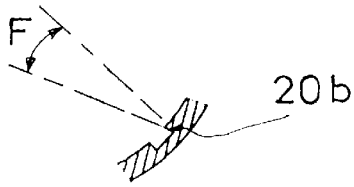

FIGS. 14*a*, 14*b*, and 14*c* respectively illustrate the cross section of the arrangement of the pivoting body's stop element according to DD, EE and FF, respectively.

According to the invention, the turning case mechanism bearing the general reference (1) is composed of two pieces, i.e., a pivoting body (2) and a main piece (3). The main piece is comprised of a base (4), a traveler (5) and articulated hinge elements (6) also called ribs that connect them and that constitute the means of blocking the rotation, intended to make the traveler and the base interlocking in order to prevent any pivoting between them.

The base (4) and the traveler (5) are blocked in rotation respectively between themselves by the hinge elements (6). These hinge elements allow the traveler (5) to move axially with respect to the base (4) in a manner known in itself the length of the axis of revolution (ZZ') of the turning case mechanism (I).

The axial movement of the traveler (5) with respect to the base (4) is achieved in a manner known in itself by the rotation of the pivoting body (2) with respect to the main piece (3) which allows one or more guide pins (7*a*, 7*b*) of the traveler (5) to move in the respective grooves (8*a*, 8*b*) journaled in the inside wall of the pivoting body (2) when it pivots.

We note that this type of turning case mechanism (1) can advantageously be used to make lipstick cases or other cosmetic or pharmaceutical products, such as lip creams. However, these mechanisms could possibly be used in other fields, such as tube glues or other.

Figure 1A:
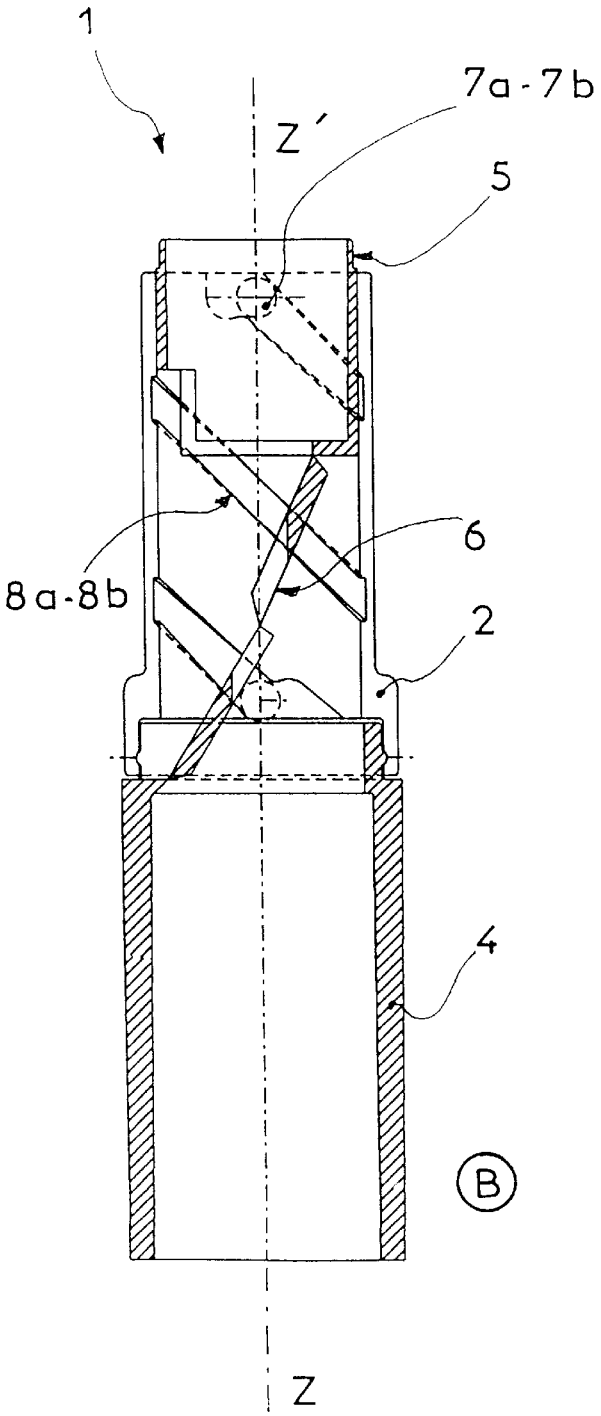

The hinge elements (6) are articulated at their upper end on the lower side of the traveler (5) and at the lower end on the upper end of the base (4), respectively at the upper and lower articulation points (9*a*, 9*b*). They allow the traveler (5) to slide along the axis of revolution (ZZ') within the pivoting body (2) between a closed or lower position A), illustrated in FIG. 2 and an open or upper position (B), illustrated in FIGS. 1*a* and 3.

According to the invention, the turning case mechanism (1) is embodied in such a manner that in the closed position (A), also called lower position, at feast a portion of the hinged elements (6) are arranged below the horizontal plane (H) that contains the lower articulation point (9*b*) of said hinge elements (6) on the base (4).

According to the preferred embodiment of the turning case mechanisms (1), the hinge elements (6) are arranged entirely below the lower articulation point (9*b*) when they are in the closed or lower position (A). In order to do this, the base (4) at its upper end is provided with a space or housing (10) in which the hinge elements are intended to be positioned, said space extending below the lower articulation point (9*b*). This space (10) can advantageously be obtained by performing a reaming out (11) of the base (4) over its entire length.

According to the preferred embodiment of the turning case mechanisms (1) according to the invention, the main piece (1) has two hinge elements or ribs (6*a*, 6*b*) articulated between themselves at an intermediary articulation point (9*c*). The first or lower element (6*b*) is articulated on the top of the base (4) at the lower articulation point (9*b*) and the upper element (6*a*) is articulated on the lower side (13) of the bottom (8*b*) of the traveler (5). The various articulations (9*a*, 9*b*, 9*c*) are advantageously obtained through means known in themselves, by shrinking or necking the wall portions constituting the hinge elements (6*a*, 6*b*). We note that according to the various embodiments of the turning case mechanism according to the invention, the pieces composing it are advantageously made of plastic by means of an injection process, for example.

Figure 1B:
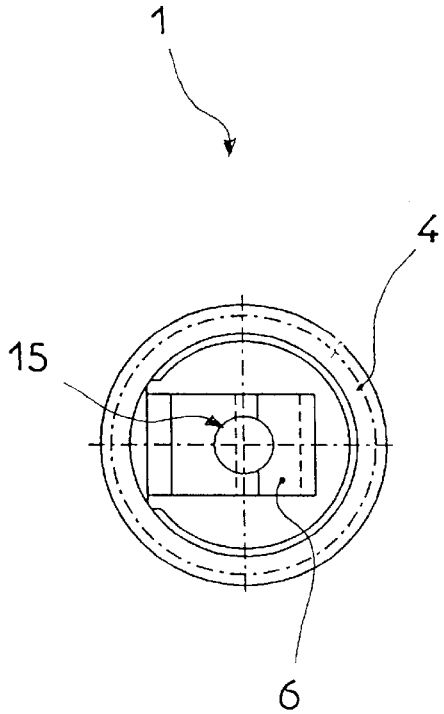
Figure 3:
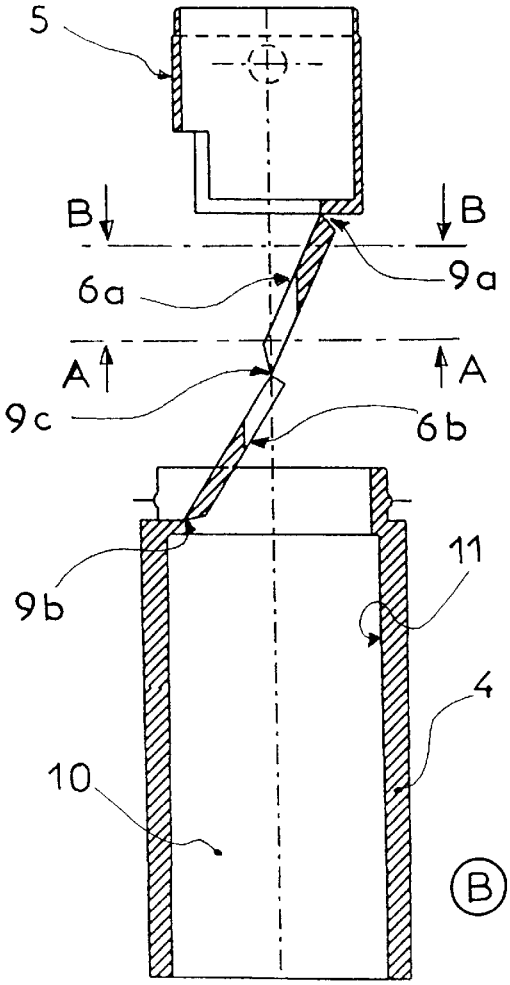
FIG. 3 illustrates a longitudinal section of the main piece in the open position.

As shown by FIGS. 1*b* and 3, the upper and lower hinge elements are arranged in the extension of each other, when the turning case mechanism (1) is in the open or upper position (B). We note that the upper (9*a*) and lower (9*b*) articulation points are advantageously arranged on either side of a median longitudinal plan containing the axis of revolution (ZZ') of the mechanism. It goes without saying that the configuration of the hinge elements could be different without as such departing from the scope of the invention.

According to the preferred embodiment of the invention, all of the hinge elements (6*a*, 6*b*) are housed beneath the lower articulation point (9*b*) when the mechanism is in a lower position (A). The lower hinge element (6*b*) preferably is positioned in an essentially vertical position, parallel to the reamed wall (11) directly below the lower articulation point (9*b*), the upper hinge element (6*a*) being slightly inclined as shown in FIG. 5 between the intermediary articulation point (9*c*) and the upper articulation point (9*a*) situated slightly above said intermediary point (9*c*).

According to the embodiment illustrated, when the turning case mechanism is in the closed or lower position (A), a portion of the traveler (5) intended for receiving the product is arranged in the housing (10) of the base (4) advantageously below the horizontal plane (H), which contains the lower articulation point (9*b*). We note, however, that according to an embodiment variation, said lower articulation point could be situated below the top of the base within the housing of said base.

Figure 4:
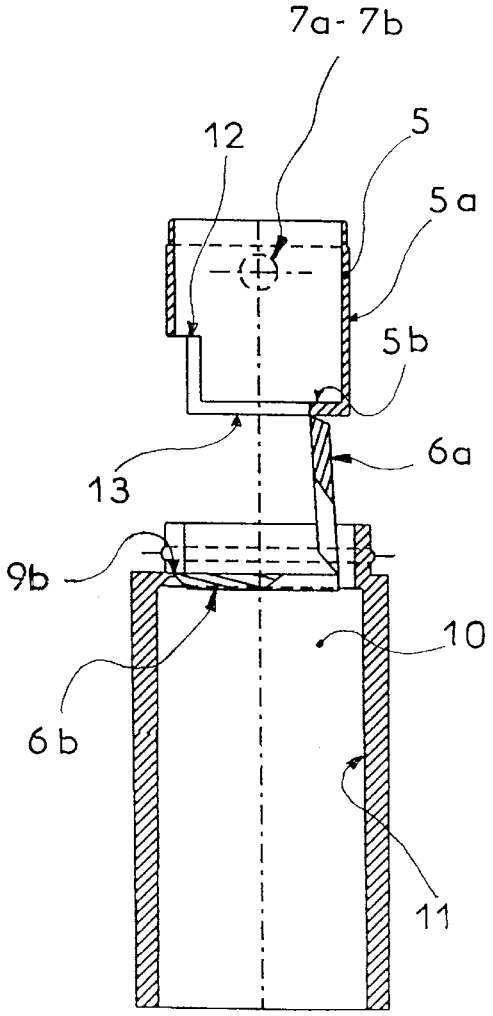
FIG. 4 illustrates a view similar to FIG. 3 of the main piece of the turning case mechanism in an intermediate position.

The traveler (5) is, in a manner known in itself, composed of a portion of a tube (8*a*) sealed at its lower end by a circular wall or bottom (5*b*). It advantageously has an offset or clearance notch (12) in its lower part, i.e., a hollowing out of a part of the peripheral tube (5*a*) and of the bottom (5*b*) as seen in FIG. 4, said notch being intended to facilitate its positioning within the reaming (11) of the base (4).

Figure 5:
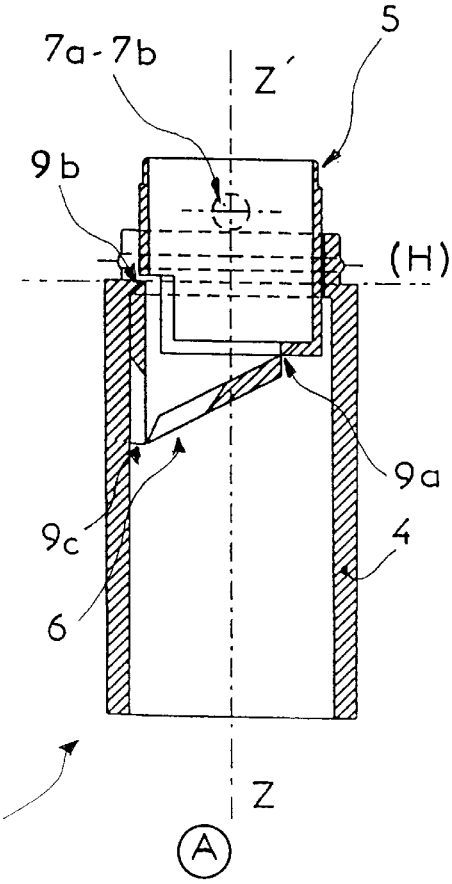
FIG. 5 represents the longitudinal section of the main piece in the lower position.

Indeed, this clearance notch (12) is positioned on the traveler (5) of the main piece (2) in its lower part in such a way that when said part is positioned in the housing (10) of the base (4), it should not be disturbed by the presence of the lower hinge element (6*b*) the latter being positioned in the notch thus provided as shown in FIG. 5.

It is important to note that when the turning case mechanism (1) is in the closed or lower position, the upper articulation point (9*a*) between the traveler (5) and the hinge elements (6, 6*a*, 6*b*) is situated below the lower articulation point (9*b*) between those elements and the base (4).

Figure 6:
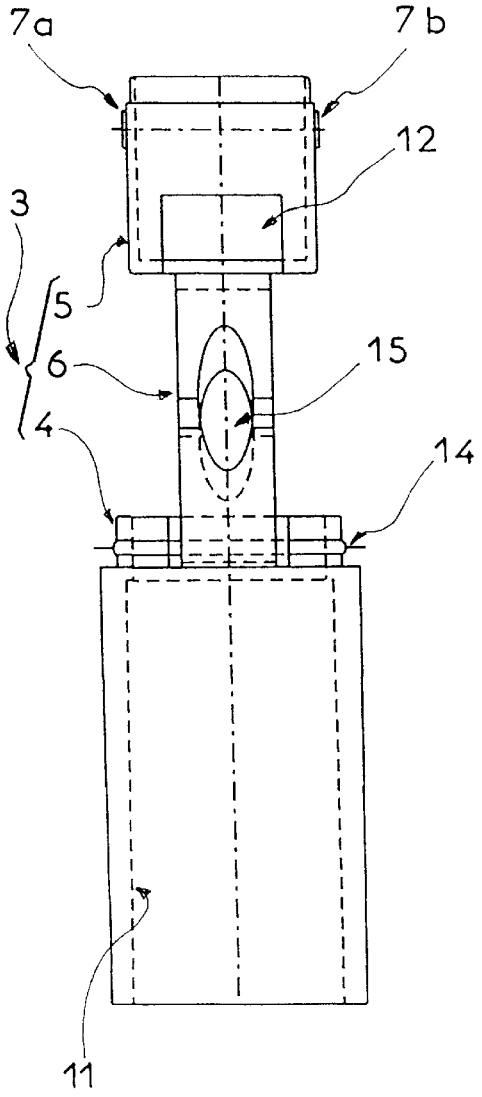
FIG. 6 illustrates a side view of the main piece in the open position.

Moreover, the hinge elements (6, 6*a*, 6*b*) of the turning case mechanism (1) advantageously have a refill opening (15) embodied in two parts, a part on each of the hinge elements (6*a*, 6*b*) as shown in FIGS. 5 and 6. This opening (15) as well as the hollowing out (12) of the bottom (5*b*) of the traveler are intended to allow the traveler to be filled with the product from the back of the mechanism, i.e., through the reamed-out portion (11) of the base (4).

According to the embodiment illustrated, the pivoting body (2) is intended to be snapped onto the base (4) of the main piece (3), said base having at its upper end, a groove for snapping (14). We note that this groove (14) makes it possible to embody the articulation in rotation between the main piece (3) and the pivoting body (2). It goes without saying that the assembly and the articulation between the pivoting body and the base could be achieved in another way, without the groove for snapping, for example, without as such departing from the scope of the invention. In addition, we note that the pivoting body (2) has two spiral grooves (8*a*, 8*b*) situated in its internal peripheral wall, diametrically opposite. These grooves are intended to cooperate with two guide pins (7*a*, 7*b*) arranged diametrically opposite, on the tube portion (5*a*) forming the traveler (5) essentially at the level of the upper end thereof as shown in FIG. 7*a*. It goes without saying that the configuration of the cooperating means between the two complementary pieces, i.e., the main piece and the pivoting body could be different and have only one groove and one pin, for example, without as such departing from the scope of the invention.

According to a variation of the first embodiment previously described in which similar parts according to their function bear the same references, the turning case mechanism has stopping means (20*a*, 20*b*, 20*c*, 21*a*, 21*b*, 21*c*) intended to prevent the movement of the traveler (5) beyond its extreme opened and closed positions. The stopping means are constituted by the cooperation of the stop surfaces (20*a*, 20*b*, 20*c*) of the pivoting body and the support surfaces (91*a*, 21*b*, 21*c*) of the traveler (5) on the main piece (3).

The support surfaces (21*a*, 21*b*, 21*c*) are advantageously arranged on the guide pins (7*a*, 7*b*) of the traveler whereas the stop surfaces (20*a*, 20*b*, 20*c*) are placed at the respective ends of the internal spiral grooves (8*a*, 8*b*) of the pivoting body. According to this embodiment variation, the stopping means comprise the following:

side support and stop surfaces (20*a*, 20*b*, 21*a*, 21*b*) intended to prevent the rotation between the pivoting body (2) and the traveler (5), respectively.

longitudinal support and stop surfaces (20*c*, 21*c*) that prevent any longitudinal movement in the open position between the traveler and the pivoting body.

The side support and stop surfaces (20*a*, 20*b*, 21*a*, 21*b*) advantageously have a non-zero angle (E, F) with the corresponding radius of the pivoting body or the traveler as shown in FIGS. 12*c*, 14*a* and 14*c*. The support surfaces (20*a*, 20*b*) are advantageously formed by the side edges of the guide pins (7*a*, 7*b*) that are beveled in such a way that they lock against the stop surfaces (21*a*, 21*b*) of the groove ends (8*a*, 8*b*) in the same manner as harpoons in order to prevent the pins from leaving their grooves when the pivoting body is forced into rotation. According to the embodiment variation as illustrated in FIG. 12*b* and 14*b*, the longitudinal support and stop surfaces (20*c*, 21*c*) make a non-zero angle G with the horizontal transverse plane. It goes without saying that the stop and support surfaces could have a different configuration and not be situated on the guide pins and the grooves without as such departing from the scope of the invention.

According to the invention and in order to allow the best possible use of the hinge elements (6*a*, 6*b*) in the housing (10) of the base (4) when the mechanism is in the closed position as shown in FIG. 10*a*, the lower hinge element (6*b*) has a rounded or curved transversal profile as illustrated in FIG. 11*b*. According to the embodiment variation illustrated in FIGS. 10*a* through 11*b*, the two hinge elements (6*a*, 6*b*) have a curved transversal profile; moreover, when the traveler is in the lower position, it can be observed that the upper hinge element (6*a*) is essentially arranged in a horizontal transversal plane, in a housing (24) provided in the lower wall (5*b*) of the traveler (5) whereas the lower hinge element (6*b*) is then positioned in the clearance notch (12) of the traveler in a vertical position.

We note that the lower hinge element (6*b*) has an outside diameter equal, within clearance, to the inside diameter of the grooved reaming (11) of the base (4) whereas the upper hinge element (6*a*) has an outside diameter and dimensions that allow it to pass within the inside diameter of the base collar. We note that the rounded or curved profile of the hinge elements constitutes a means for stiffening the hinge elements for the purpose of providing them with greater resistance to twisting.

According to the invention, the main piece (3) is advantageously fabricated in plastic, said material being chosen among polyolefins such as polypropylene, polyethylene and among acetylics such as polyoxymethylene. It goes without saying that other materials or other plastics could be used to embody the turning case according to the invention.

Naturally, the invention is not limited to the embodiment described and represented here by way of example, but it includes all technical equivalents as well as their combinations.

What is claimed is:

1. Turning case mechanism (1) in particular for cosmetic products, constituted of ai pivoting body (2) mounted in rotation on a main piece (3), formed of a traveler (5), a base (4) and hinge elements (6, 6*a*, 6*b*) connecting the base to the traveler, between a lower articulation point (9*b*) with the base and an upper articulation point (9*a*) with the traveler (5), said traveler is capable of moving between an open or upper position (B) and a closed or lower position (A), characterized in that when the traveler (5) is in its lower position (A), the hinge elements (6, 6*a*, 6*b*) are arranged at least in part inside the base and below the horizontal plane (H) that contains the lower articulation point (9*b*).

2. Turning case mechanism (1), according to claim 1, wherein the base (4) has a space (10) extending below the lower articulation point (9*b*), in which the hinge elements (6, 6*a*, 6*b*), are at least partly positioned when the traveler is in the lower position (A).

3. Turning case mechanism (1), according to claim 2, wherein the space (10) is formed by the reaming out (11) of the base (4).

4. Turning case mechanism (1), according to claim 2, characterized in that when the traveler (5) is in the lower position (A), all of the hinge elements (6, 6*a*, 6*b*) are arranged below the horizontal plane (H).

5. Turning case mechanism (1), according to claim 2, wherein the hinge elements are composed of two elements, a lower element (6*b*) and an upper element (6*a*) articulated between each other at an intermediate articulation point (9*c*).

6. Turning case mechanism (1), according to claim 5, wherein the lower articulation point (9*b*), between the base (4) and the lower element (6*b*), and the upper articulation point (9*a*), between the traveler (5) and the upper element (6*a*), are arranged on either side of a median longitudinal plane, the lower and upper elements being aligned when the traveler is in its open or upper position (B).

7. Turning case mechanism (1), according to claim 5, characterized in that when the traveler (5) is in its lower or closed position (A), all of the hinge elements (6*a*, 6*b*) are housed under the lower articulation point (9*b*), the lower hinge element (6*b*) is positioned in all essentially vertical position, directly under the lower articulation point (9*b*), the hinge element (6*a*) being slightly inclined between an intermediate articulation point (9*c*) and the upper articulation point (9*a*).

8. Turning case mechanism (1), according to claim 1, wherein at least a part of the traveler (5) is arranged under the horizontal plane (H), when the latter is in the lower or closed position (A).

9. Turning case mechanism (1), according to claim 8, wherein the traveler (5) has in its lower portion a clearance notch (12) in which one of the hinge elements is positioned in part, when the mechanism is in the lower or closed position (A).

10. Turning case mechanism (1), according to claim 8, characterized in that when the traveler (5) is in the lower or closed position (A), the upper articulation point (9*a*) is situated below the horizontal plane (H) that contains the lower articulation point (9*b*).

11. Turning case mechanism (1), according to claim 1, wherein it has stopping means (20*a*, 20*b*, 20*c*, 21*a*, 21*b*, 21*c*) composed of stop surfaces on the pivoting body (2) and support surfaces of the traveler (5) of the main piece (3).

12. Turning case mechanism (1) according to claim 11, wherein support surfaces (20*a*, 20*b*, 20*c*) are arranged on the guide pins (7*a*, 7*b*) of the traveler (5) and are formed by the beveled surfaces of the pins.

13. Turning case mechanism (1) according to claim 11, wherein the stop surfaces (21*a*, 21*b*, 21*c*) are arranged in internal grooves (8*a*, 8*b*) of the pivoting body (2) at their respective ends.

14. Turning case mechanism (1), according to claim 11, wherein the stopping means have side support and stop surfaces (20*a*, 20*b*, 21*a*, 21*b*) that prevent rotation between the traveler and be pivoting body in the extreme closed and open positions of the traveler and longitudinal support and stop surfaces (20*c*, 21*c*) that prevent any longitudinal movement of the traveler in the pivoting body when it is in the open position.

15. Turning case mechanism (1), according to claim 1, wherein the hinge elements (6*a*, 6*b*) have a transversal rounded or curved profile.

16. Turning case mechanism (1), according to claim 1, wherein the main piece (3) is embodied in a plastic material chosen from among polyolefin and acetylic materials.

* * * * *